United States Patent [19]

Morita

[11] Patent Number: 4,561,161

[45] Date of Patent: Dec. 31, 1985

[54] METHOD OF AND APPARATUS FOR AUTOMATICALLY ATTACHING TOP STOPS TO A GAPPED SLIDE FASTENER CHAIN WITH SLIDES MOUNTED THEREON

[75] Inventor: Toyoo Morita, Uozu, Japan

[73] Assignee: Yoshida Kogyo K.K., Tokyo, Japan

[21] Appl. No.: 737,566

[22] Filed: May 23, 1985

Related U.S. Application Data

[63] Continuation of Ser. No. 473,542, Mar. 9, 1983, abandoned.

[30] Foreign Application Priority Data

Mar. 17, 1982 [JP] Japan ..... 57-42209

[51] Int. Cl.[4] ..... B21D 53/56

[52] U.S. Cl. ..... 29/408; 29/33.2; 29/767

[58] Field of Search ..... 29/408, 409, 707, 715, 29/767, 768, 782, 33.2, 564.6

[56] References Cited

U.S. PATENT DOCUMENTS

| | | | |
|---|---|---|---|
| 3,504,418 | 4/1970 | Perlman | 29/707 |
| 3,541,662 | 11/1970 | Perlman | 29/767 X |
| 3,863,321 | 2/1975 | Perlman | 29/408 |
| 4,203,207 | 5/1980 | Oyama | 29/767 |
| 4,217,685 | 8/1980 | Seki | 29/408 |
| 4,368,570 | 1/1983 | Morita | 29/408 |
| 4,381,593 | 5/1983 | Yoshieda et al. | 29/767 X |

*Primary Examiner*—Gil Weidenfeld
*Assistant Examiner*—Glenn L. Webb
*Attorney, Agent, or Firm*—Hill, Van Santen, Steadman & Simpson

[57] ABSTRACT

A longitudinally gapped, continuous slide fastener chain with sliders slidably mounted thereon is longitudinally fed by a feed roller through an apparatus including a top stop applicator mechanism. When the slider on a pair of coupling element rows is sensed by a slider sensor, the feed roller is stopped and a chain stop lever is lowered into a gap adjacent to the coupling element rows. The feed roller is rotated again to feed the slide fastener chain again to displace the chain stop lever slightly downstream by engagement with a bottom stop attached to a following length of coupling element rows. When the slide fastener chain is stopped again, a chain deflector is lowered transversely into the path of the slide fastener chain to depress the chain so that the chain located downstream of the chain deflector is pulled back until the ends of the coupling element rows where top stops are to be applied are bought into clinching dies. After the chain deflector has been fully lowered, a main shaft is rotated through one revolution for actuating a top stop cutter to cut a pair of top stop blanks out of a flat wire bar and for lowering a curling punch to clinch top stops around the rows of coupling elements at their ends in the clinching dies. The foregoing cycle of top stop attaching operation is repeated for successively attaching top stops to the slide fastener chain.

8 Claims, 20 Drawing Figures

METHOD OF AND APPARATUS FOR AUTOMATICALLY ATTACHING TOP STOPS TO A GAPPED SLIDE FASTENER CHAIN WITH SLIDES MOUNTED THEREON

This is a continuation of application Ser. No. 473,542, filed Mar. 9, 1983, now abandoned.

BACKGROUND OF THE INVENTION

1. Field of the Invention

The present invention relates to a method of and an apparatus for automatically attaching top stops to a longitudinally gapped, continuous slide fastener chain at ends of longitudinally spaced rows of coupling elements with sliders slidably mounted thereon, respectively.

2. Prior Art

For applying top stops to a continuous slide fastener chain, it has been customary to move upwardly a tongue-shaped chain spreader between stringer tapes adjacent to ends of rows of coupling elements, and then attach the top stops to the ends of coupling element rows on the stringer tapes spaced laterally from each other. The chain spreader tends to loosen and lift confronting edges of the tapes as they are spread apart. Since there has been no mechanism for holding the tape edges stably down against lower dies, the chain spreader has caused the tape edges to buckle up. In the past, top stops have often been merely applied to the tape edges without checking them for the way in which they are supported. The tongue-shaped chain spreader as it spreads the chain is held in point-to-point contact with coupling elements, so that the chain spreader fails to guide and support the ends of rows of coupling elements stably along the direction of travel of the slide fastener chain. With the above prior process, therefore, top stops cannot be reliably and accurately applied to the edges of the stringer tapes, and the attaching operation cannot be speeded up.

In an effort to eliminate the prior difficulties, the applicant has proposed a method of and an apparatus for automatically attaching top stops to a longitudinally gapped, continuous slide fastener chain with sliders slidably mounted thereon. According to the proposed arrangement, confronting edges of stringer tapes where top stops are to be applied are kept parallel to each other with the tapes being stably placed in position by a tape presser. Top stops can automatically be attached to a slide fastener chain reliably and in good condition at an increased rate of attachment. In operation, the feed of the chain is stopped at the detection of a slider positioned on a pair of coupling element rows and spaced a distance from the ends of the coupling element rows where top stops are to be attached, in the direction in which the chain travels. Then, a chain stopper, inserted in a gap in the chain and held against a bottom stop thereon, is actuated to move the chain until the ends of the coupling element rows are positioned on clinching dies. This positioning method is disadvantageous in that varying lengths of spaces or gaps in the chain cause incorrect positioning of the ends of the coupling element rows. Another problem is that a detector, for detecting the chain stopper as pushed by the bottom stop when the chain is fed a constant interval, cannot easily be adjusted in position to meet different space lengths.

SUMMARY OF THE INVENTION

It is an object of the present invention to provide a method of automatically attaching top stops to a longitudinally gapped, continuous slide fastener chain while accommodating spaces or gaps of varying lengths in the slide fastener chain.

Another object of the present invention is to provide an apparatus for carrying out the above method.

According to the present invention, a slide fastener chain, longitudinally gapped with sliders slidably mounted on respective rows of coupling elements, is fed along by a feed roller through an apparatus including a top stop applicator mechanism. When one of the sliders, on an individual length of coupling element rows to which top stops are to be attached, is sensed by a slider sensor, the feed roller is stopped and a chain stop lever is lowered by a fluid cylinder into a gap adjacent to the coupling element rows until a detector lever below the chain stop lever is depressed to actuate a limit switch which then issues a signal to start the feed roller again. The chain stop lever is then slightly displaced downstream by a bottom stop attached to a following length of coupling element rows, whereupon the detector lever is also angularly displaced by engagement with the chain stop lever. Another limit switch is inactivated by the tilted detector lever to produce a signal to stop the feed roller and operate a chain deflector. A chain deflector is lowered into the path of the slide fastener chain to depress the chain so that the chain located downstream of the chain deflector is moved back until the ends of the coupling element rows where top stops are to be applied are brought into clinching dies. After the chain deflector has been fully lowered with the ends of the coupling element rows stopped in place in the clinching dies, a timer is started and, upon elapse of a preset time interval, issues a signal to rotate a main shaft through one revolution for actuating a top stop cutter to cut a pair of top stop blanks out of a flat wire bar and lower a curling punch to clinch top stops around the rows of coupling elements at their ends in the clinching dies. The foregoing cycle of top stop attaching operation is repeated over and over again.

Since the slide fastener chain is deflected and moved back each time top stops are applied to bring the ends of rows of coupling elements accurately into alignment with the clinching dies and the curling punch, the top stops can be attached correctly even when the spaces or gaps between individual lengths of coupling element rows have different lengths. Slide fastener chains of different gap lengths can easily be accommodated with simple adjustments. An apparatus for effecting the method of the present invention can be automatically driven for successive high-speed operations for attaching top stops to a continuous slide fastener chain. The apparatus can immediately be automatically stopped in response to detection of misplaced stringer tapes which would otherwise cause top stops to be attached improperly.

Many other advantages, features and additional objects of the present invention will become manifest to those versed in the art upon making reference to the detaied description and the accompanying sheets of drawings in which a preferred embodiment incorporating the principles of the present invention is shown by way of illustrative example.

DETAILED DESCRIPTION

The terms "front", "rear", "upstream", "downstream" and the like are used herein with reference to the direction in which a slider fastener chain is normally fed along through an apparatus according to the present invention.

Figure 1:
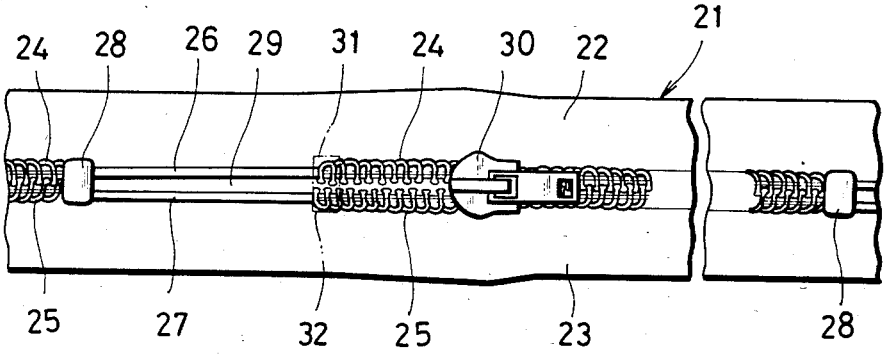
FIG. 1 is a fragmentary plan view of a longitudinally gapped, continuous slide fastener chain with sliders mounted on spaced rows of coupling elements.

As shown in FIG. 1, a slide fastener chain 21 to which top stops are to be applied comprises a pair of slide fastener tapes 22, 23 having on their inner longitudinal edges longitudinally spaced pairs of rows of coupling elements 24, 25 mounted on a pair of reinforcing core cords 26, 27, respectively, on the longitudinal tape edges. Each pair of rows of coupling elements 24, 25 has a bottom stop 28 secured to one end thereof. The pairs of rows of coupling elements 24, 25 are longitudinally separated by spaces or gaps 29 which are free of any coupling elements. A slider 30 is slidably mounted on each pair of rows of coupling elements 24, 25 for taking the rows of coupling elements 24, 25 into and out of intermeshing engagement. The slider 30 is shown as being displaced from ends of the rows of coupling elements 24, 25 which are remote from the opposite end where the bottom stop 28 is mounted, thus leaving some of the coupling elements disengaged. A pair of top stops 31, 32, shown by the imaginary lines, will be applied to the ends of the disengaged rows of coupling elements according to the present invention.

Figure 2:
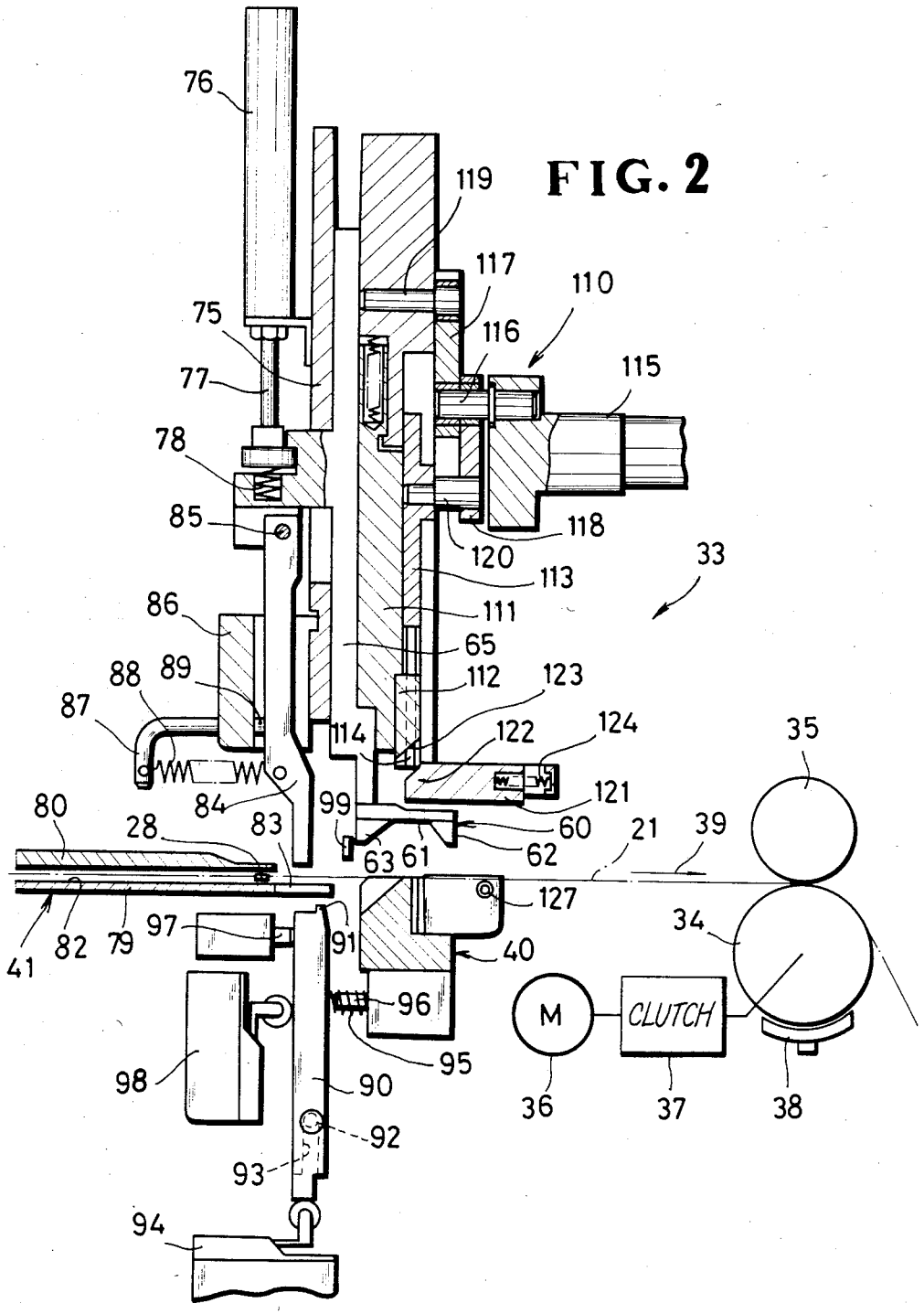
FIG. 2 is a vertical cross-sectional view of an apparatus according to the present invention, the apparatus being in a position prior to operation for top stop attachment.

In FIG. 2, an apparatus 33 for automatically applying top stops to the slide fastener chain 21 has a chain feeder including a feed roller 34 and a presser roller 35 for sandwiching the slide fastener chain 21 therebetween. The feed roller 34 is operatively coupled with a motor 36 through an electromagnetic clutch 37. The feed roller 34 can be stopped by an electromagnetic brake 38. When the feed roller 34 is driven by the motor 36, the slide fastener chain 21 is fed along in the direction of the arrow 39 through the apparatus 33.

Figure 13:
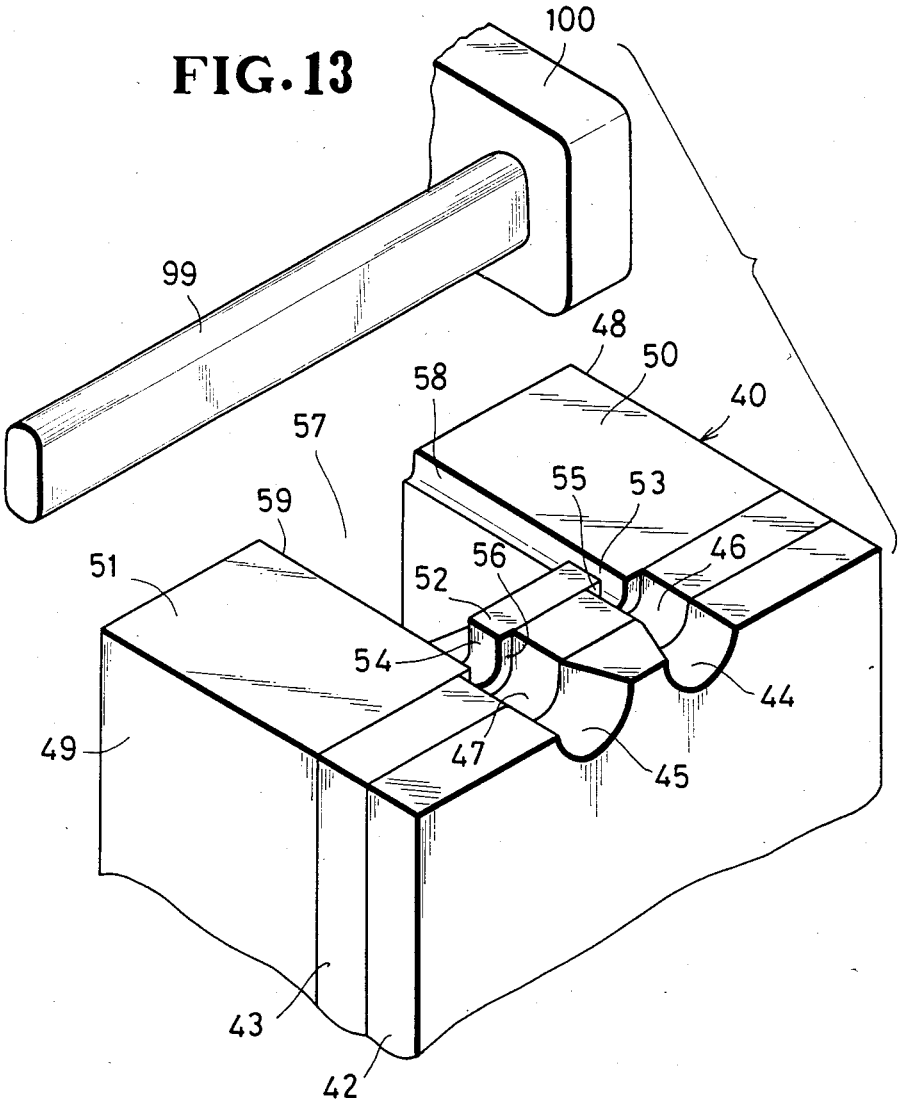
FIG. 13 is a perspective view of an element row end positioner and the chain deflector.

The apparatus 33 includes front and rear guides 40, 41 disposed upstream of the chain feeder with respect to the direction of travel of the slide fastener chain 21 for slidably supporting the stringer tapes 22, 23. The front guide 40 comprises, as shown in FIG. 13, a pair of vertical plates 42, 43 attached to each other. The plate 42 has in its upper edge a pair of element guide slots 44, 45 spaced laterally from each other and having inner faces slightly flaring in the downstream direction. The plate 43 has in its upper edge a pair of clinching dies 46, 47 substantially in registry with the element guide slots 44, 45. The upper edges of the element guide slots 44, 45 are aligned with the upper edges of the clinching dies 46, 47 in the direction of feed of the slide fastener chain 21. The plates 42, 43 are followed by a pair of transversely spaced blocks 48, 49 having upper surfaces 50, 51, respectively, for supporting the stringer tapes 22, 23, respectively. The blocks 48, 49 are interconnected by an element stopper 52 positioned adjacent to the plate 43 and having a pair of recesses 53, 54 and a pair of element stopping edges 55, 56 extending around the recesses 53, 54, respectively, and facing the clinching dies 46, 47, respectively. The blocks 48, 49 are separated by a space 57 therebetween and have a pair of core cord guide steps 58, 59, respectively, facing the space 57 and extending into the recesses 53, 54, respectively, substantially in alignment with the element guide slots 44, 45 and the clinching dies 46, 47.

Figure 4:
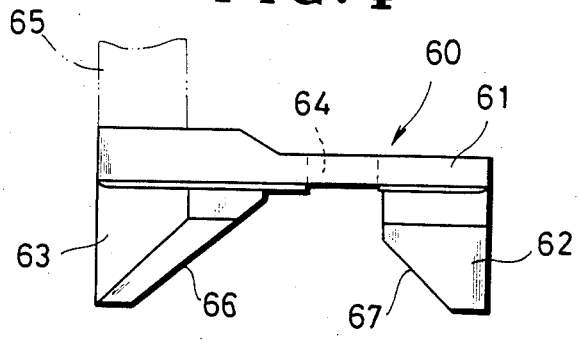
FIG. 4, appearing with FIG. 1, is a front elevational view of a chain opening pad in the apparatus.
Figure 12:
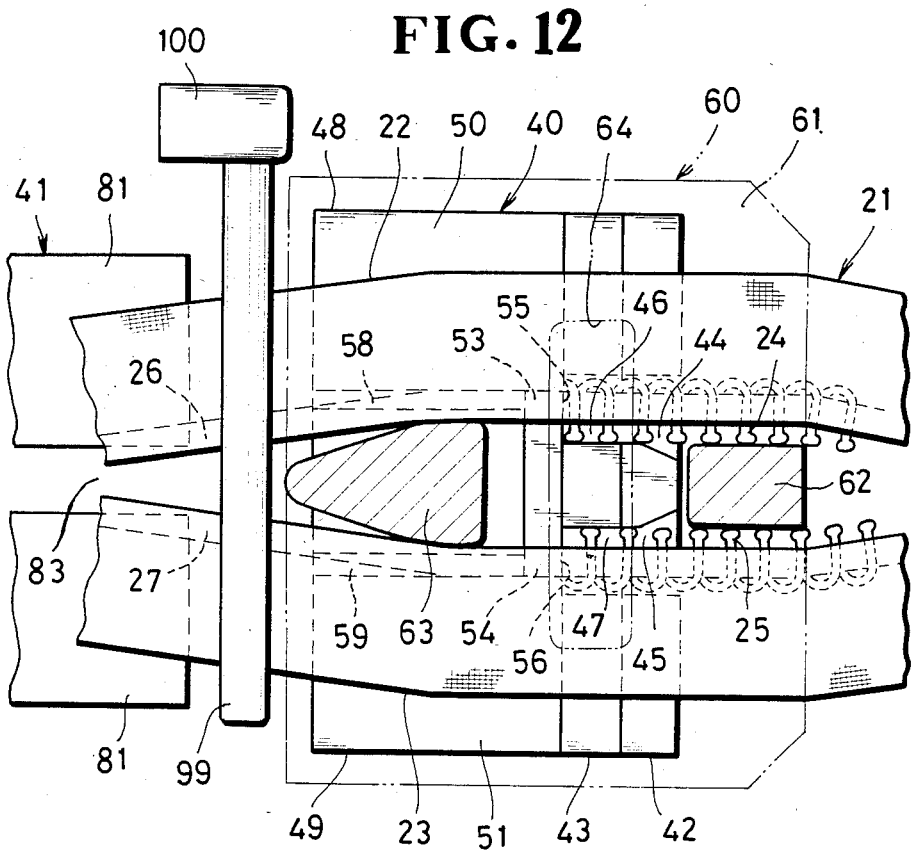
FIG. 12 is an enlarged plan view, with parts in cross section, of the parts shown in FIG. 11.
Figure 14:
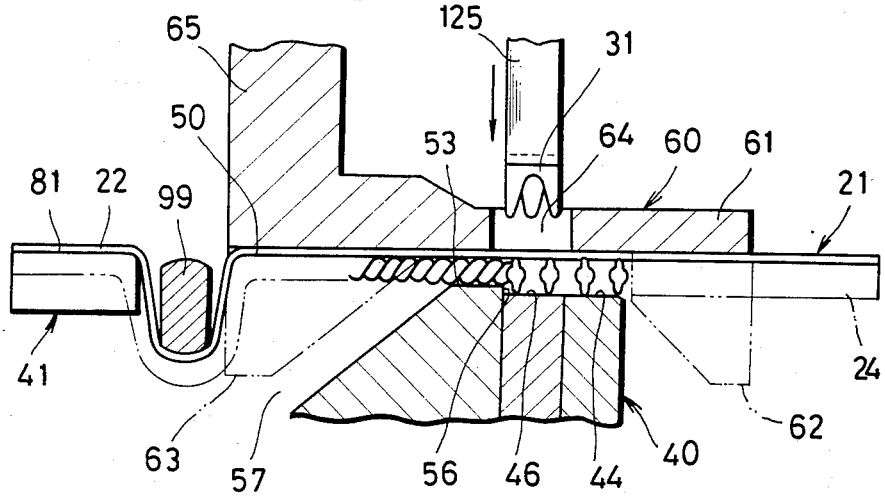
FIG. 14 is an enlarged vertical cross-sectional view illustrating the manner in which top stops are attached to the rows of coupling elements.
Figure 16:
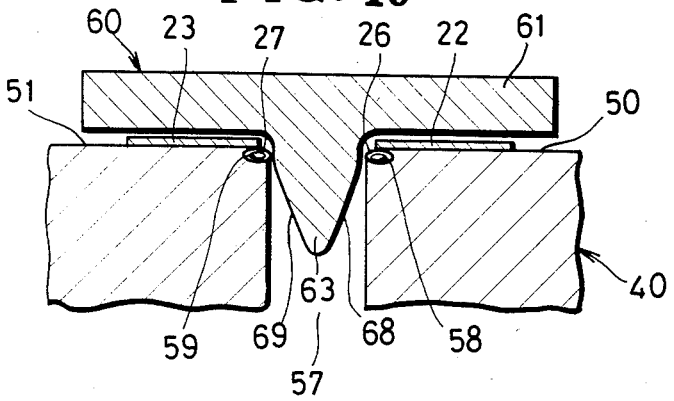
FIG. 16 is an enlarged fragmentary cross-sectional view taken along line XVI—XVI of FIG. 15.
Figure 17:
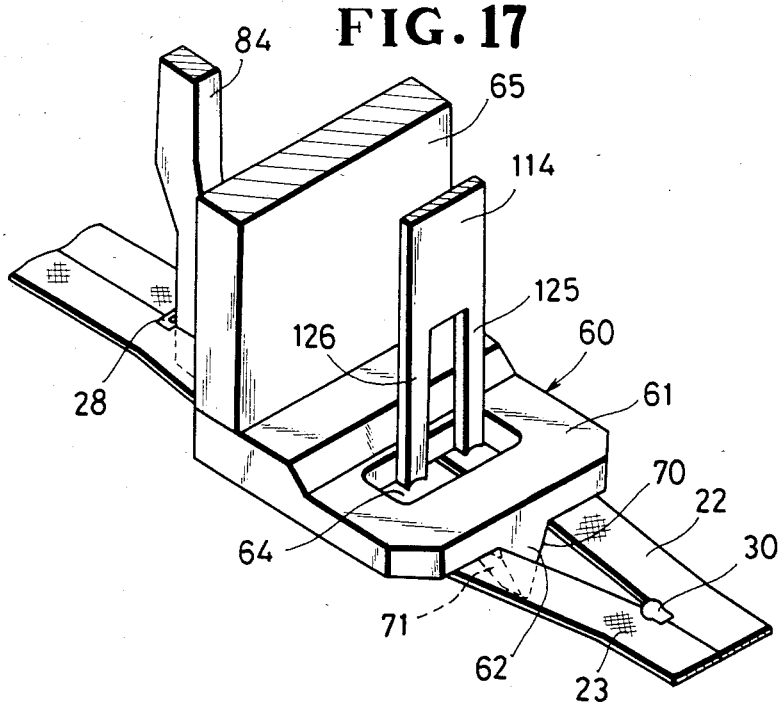
FIG. 17 is a fragmentary perspective view illustrative of the way in which the top stops are attached.
Figure 18:
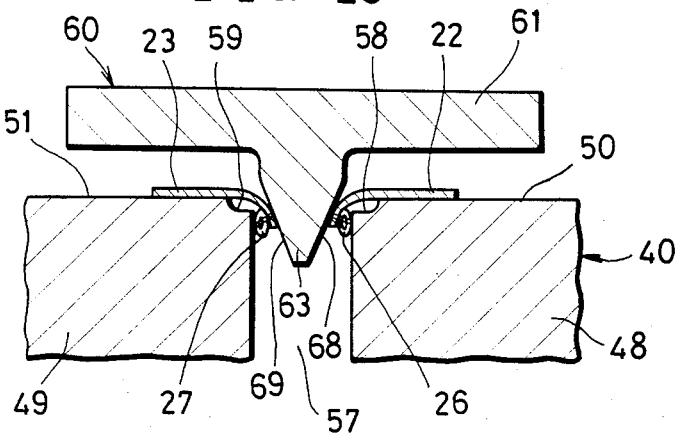
FIGS. 18 and 19 are enlarged fragmentary cross-sectional views showing conditions in which a chain is misplaced, thereby jamming certain operating parts of the apparatus.

The slide fastener chain 21 can be opened by a chain opening pad 60 (FIGS. 2 and 4) to spread the stringer tapes 22, 23 laterally apart in parallel relationship at the gap 29 and adjacent to the coupling elements 24, 25. The chain opening pad 60 has a presser plate 61 and a pair of front and rear legs 62, 63 depending therefrom and spaced longitudinally from each other. The presser plate 61 has a rectangular opening 64 (FIG. 17) positioned between the front and rear legs 62, 63 and held in vertical alignment with the clinching dies 46, 47 (FIG. 14). The presser plate 61 is supported at its rear end on a lower end of a pad holder 65 which is vertically movable. As illustrated in FIG. 12, the front leg 62 has a proximal end of a lateral dimension or thickness smaller than that of the proximal end of the rear leg 63 by two times the lateral projection of each coupling element beyond the core cord 26, 27. The front and rear legs 62, 63 have the confronting edges 66, 67 inclined away from each other in the downward direction, as shown in FIG. 4. As shown in FIGS. 16 and 18, the rear leg 63 has a downward taper defined by a pair of side faces 68, 69. As shown in FIG. 17, the front leg 62 also has a downward converging taper defined by a pair of side faces 70, 71. When the chain opening pad 60 is fully lowered by the pad holder 65, as shown in FIG. 14, the front leg 62 is disposed in front of the front guide 40 and the rear leg 63 is located in the space 57 in the front guide 40, spreading the stringer tapes 22, 23 widely apart laterally by means of the inclined side faces 68, 69 and 70, 71.

As shown in FIG. 2, the pad holder 65 is vertically slidably supported by a machine frame 75. A fluid cylinder 76 is secured to the machine frame 75 and has a piston rod 77 connected by a compression spring 78 to the pad holder 65. Since the pad holder 65 is resiliently coupled to the fluid cylinder 76, the presser plate 61 of the chain opening pad 60 when lowered can resiliently press the slide fastener chain 21 down against the chain guide 40.

The rear guide 41 comprises a slide base 79 and a tape presser 80 spaced upwardly from the slide base 79. The slide base 79 has an upper surface 81 (FIGS. 12 and 19) having a longitudinal groove 82 for guiding the sliders 30 on the slide fastener chain 21. The slide base 79 also has a slot 83 in its front end for passage therethrough of a chain stop lever 84, the slot 83 being aligned with and communicating with the groove 82. The chain stop lever 84 is generally positioned above the rear guide 41 and is pivotably mounted by a pin 85 (FIG. 2) on the pad holder 65 for angular movement in the direction of feed of the slide fastener chain 21. A restrictor 86 is secured to the machine frame 75 and supports an L-shaped rod 87. A tension spring 88 is connected between the rod 87 and the chain stop lever 84 for normally urging the latter to swing clockwise against a stop 89 disposed in the restrictor 86.

A detector lever 90 is pivotably disposed below the chain stop lever 84 in substantial vertical alignment therewith. The detector lever 90 has an engagement projection 91 on its upper end and a lateral pin 92 near the lower end. The lateral pin 92 rides in a vertical guide slot 93 defined in the machine frame 75. The lower end of the detector lever 90 is positioned immediately above a limit switch 94. The detector lever 90 is normally urged by a spring (not shown) in an upward direction to keep the lower end out of contact with the limit switch 94. The detector lever 90 is also normally urged by a compression spring 95 disposed around a stop 96 to turn counterclockwise about the pin 92 against a receiver pin 97. At this time, a limit switch 98 is closed by the detector lever 90.

Figure 7:
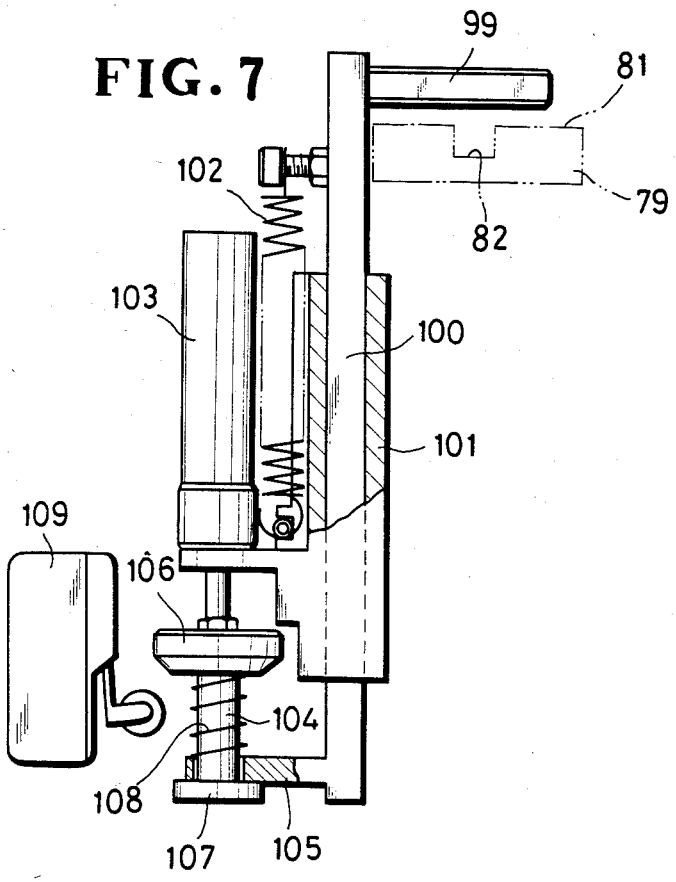
FIGS. 7 and 8 are side elevational views, partly cut away, of a mechanism for elevating and lowering a chain deflector.
Figure 8:
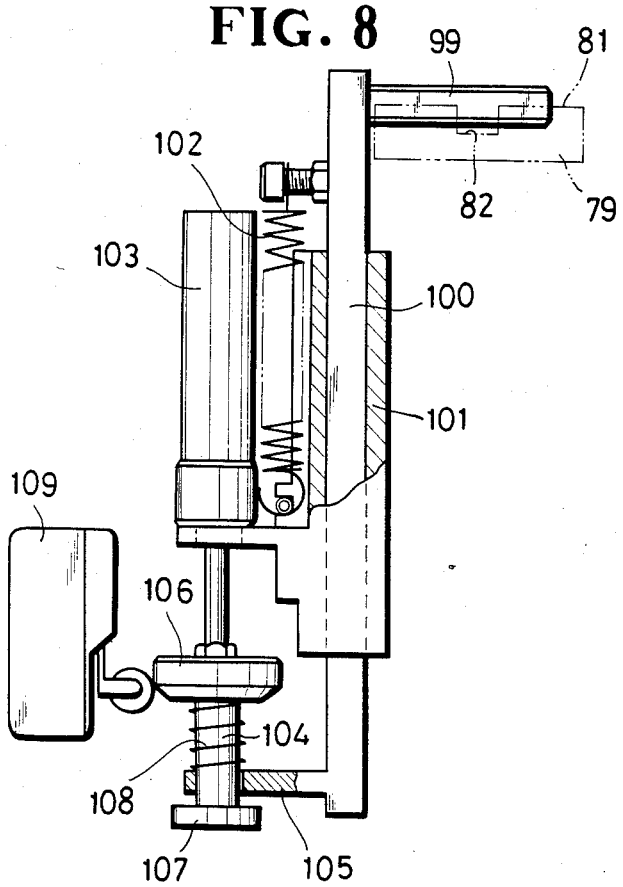
Figure 9:
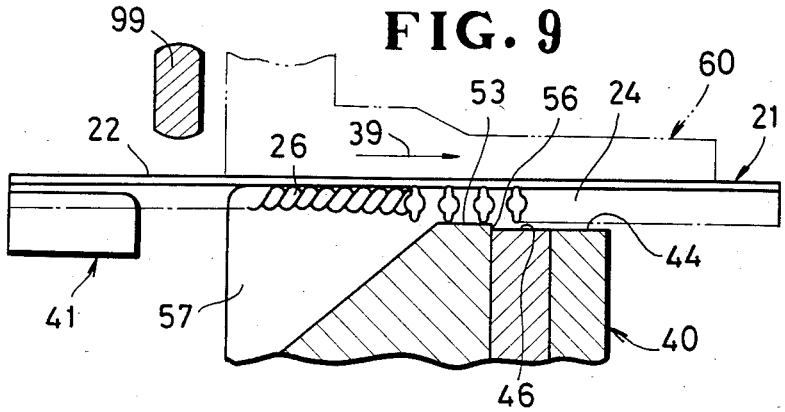
FIGS. 9 through 11 are enlarged vertical cross-sectional views showing successive steps of positioning ends of rows of coupling elements for registry with top end stops to be attached thereto.
Figure 10:
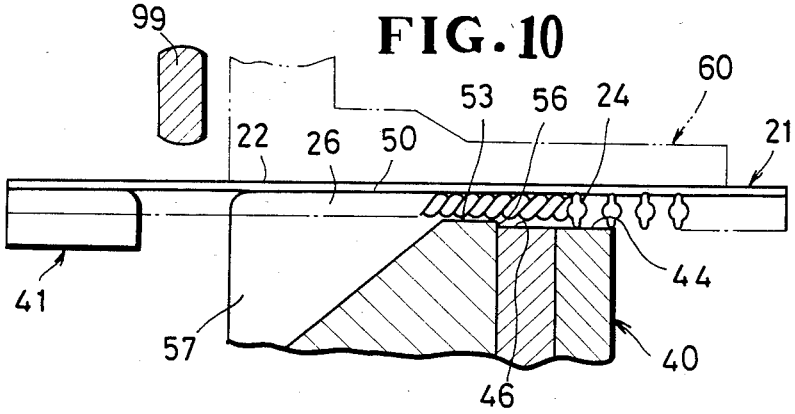
Figure 11:
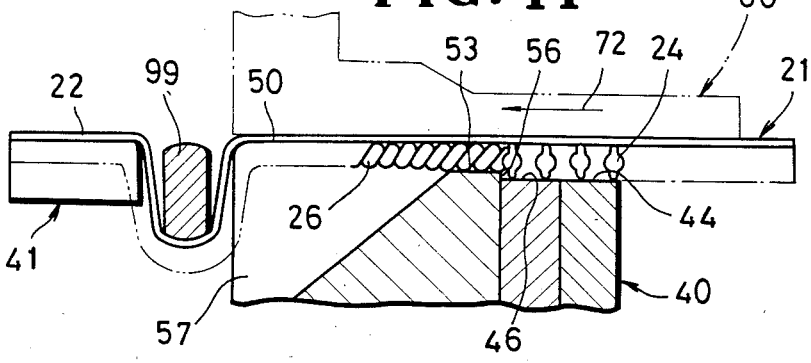

A chain deflector 99 is vertically movably disposed between the front and rear guides 40, 41 for movement into and out of the path of the slide fastener chain 21. The chain deflector 99 extends transversely of the direction of feed of the slide fastener chain 21. As shown in FIGS. 7 and 8, the chain deflector 99 is supported at one end on an upper end of a holder bar 100 vertically slidably mounted in a guide frame 101 integral with the machine frame 75. The holder bar 100 is normally urged to move downwardly under the force of a tension spring 102 acting between the holder bar 100 and the guide frame 101. A fluid cylinder 103 is mounted on the guide frame 101 and has a piston rod 104 which extends through a hole defined in a lateral plate 105 projecting from a lower end of the holder bar 100. The piston rod 104 supports thereon a disc 106 and a flange 107 mounted on a distal end of the piston rod 104 and spaced axially from the disc 106. A compression spring 108 is coiled around the piston rod 104 and acts between the disc 106 and the plate 105 for resiliently holding the lateral plate 105 against the flange 107. A limit switch 109 is positioned so that it will be closed by the disc 106 when the fluid cylinder 103 is actuated to extend the piston rod 104 for thereby lowering the chain deflector 99.

A top stop applicator mechanism 110 (FIG. 2) has a cutter holder 111 mounting a cutter 112 on its lower end, and a punch holder 113 supporting a curing punch 114 held in vertical alignment with the opening 64 in the chain opening pad 60. The cutter holder 111 and the punch holder 113 are mutually slidably held against each other and are mounted on the machine frame 75 for upward and downward movement. A horizontal main shaft 115 is rotatably supported on the machine frame 75 and supports an eccentric pin 116 to which the cutter holder 111 is operatively coupled through a link 117 and a pin 119, and to which pin 116 the punch holder 113 is operatively coupled through a link 118 and a pin 120. The links 117, 118 are attached such that they extend upwardly and downwardly, respectively, from the eccentric pin 116 when the latter is in a uppermost position. When the main shaft 115 makes one revolution, the cutter 112 and the curling punch 114 move downwardly at different speeds. More specifically, the cutter 112 is lowered at a higher speed during a first half of one revolution of the main shaft 115, while the curling punch 114 is lowered at a higher speed during a latter half of one revolution of the main shaft 115. Although not shown, the main shaft 115 has a rear end connected through a clutch to a V-belt pulley rotatable at all times by a motor through a V-belt speed reducer and transmission mechanism. The clutch is automatically disconnected each time the main shaft 115 makes one revolution.

A stop 121 is horizontally slidably supported on the machine frame 75 for slidable movement in the direction of feed of the slide fastener chain 21. The stop 121 has a pair of a laterally spaced benders 122 (only one shown in FIG. 2) engageable with a slanted surface 123 on the lower end of the cutter 112. The stop 121 is normally urged by a comprission spring 124 to move into the path of the cutter 112 and the curling punch 114.

As illustrated in FIG. 17, the curling punch 114 includes a pair of laterally spaced punch legs 125, 126 movable into and out of the rectangular opening 64 in the chain opening pad 60.

In FIG. 2, a slider sensor 127 is located in front of the front guide 40 for sensing a slider on the chain 21 as it is fed along over the front guide 40.

Figure 3:
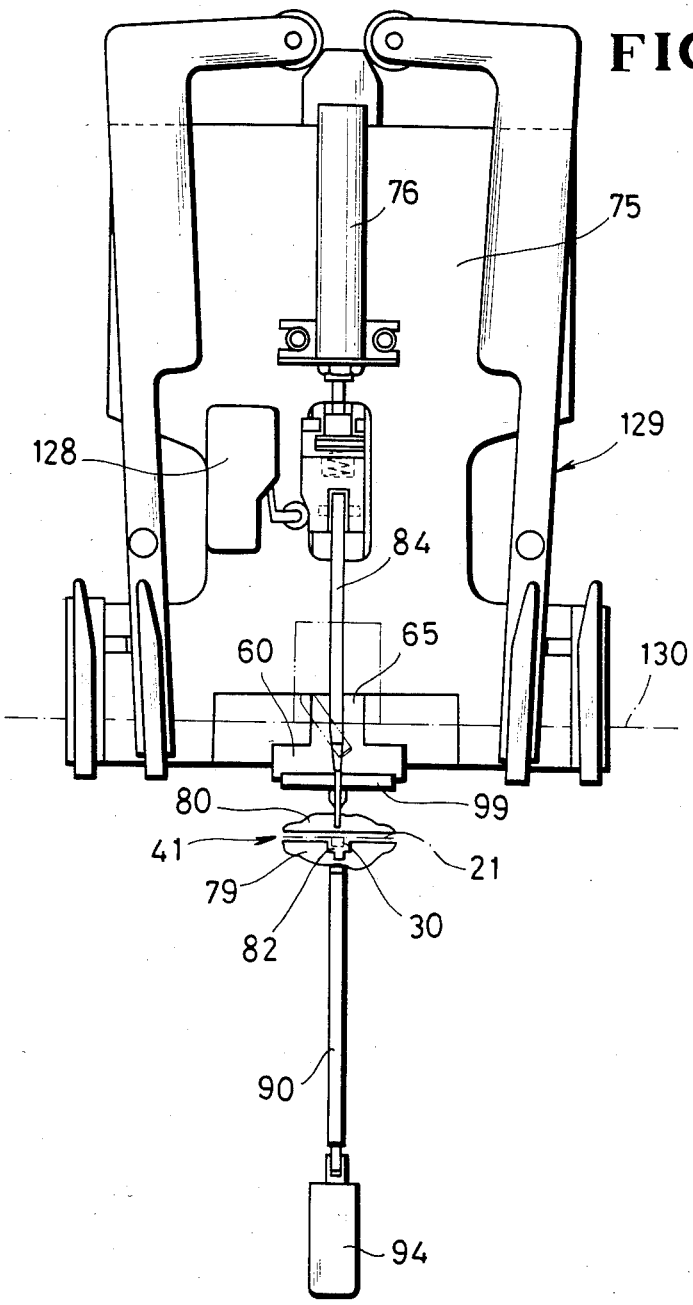
FIG. 3 is a side elevational view of the apparatus shown in FIG. 2.

As shown in FIG. 3, a limit switch 128 is mounted on the machine frame 75 and is actuatable by the pad holder 65 when the latter is moved upwardly. A wire feeder mechanism 129 shown in FIG. 3 serves to feed a flat wire bar 130 intermittently each time a pair of top stop blanks is cut off from the flat wire bar 130 by the cutter 112 as described below.

Figure 5:
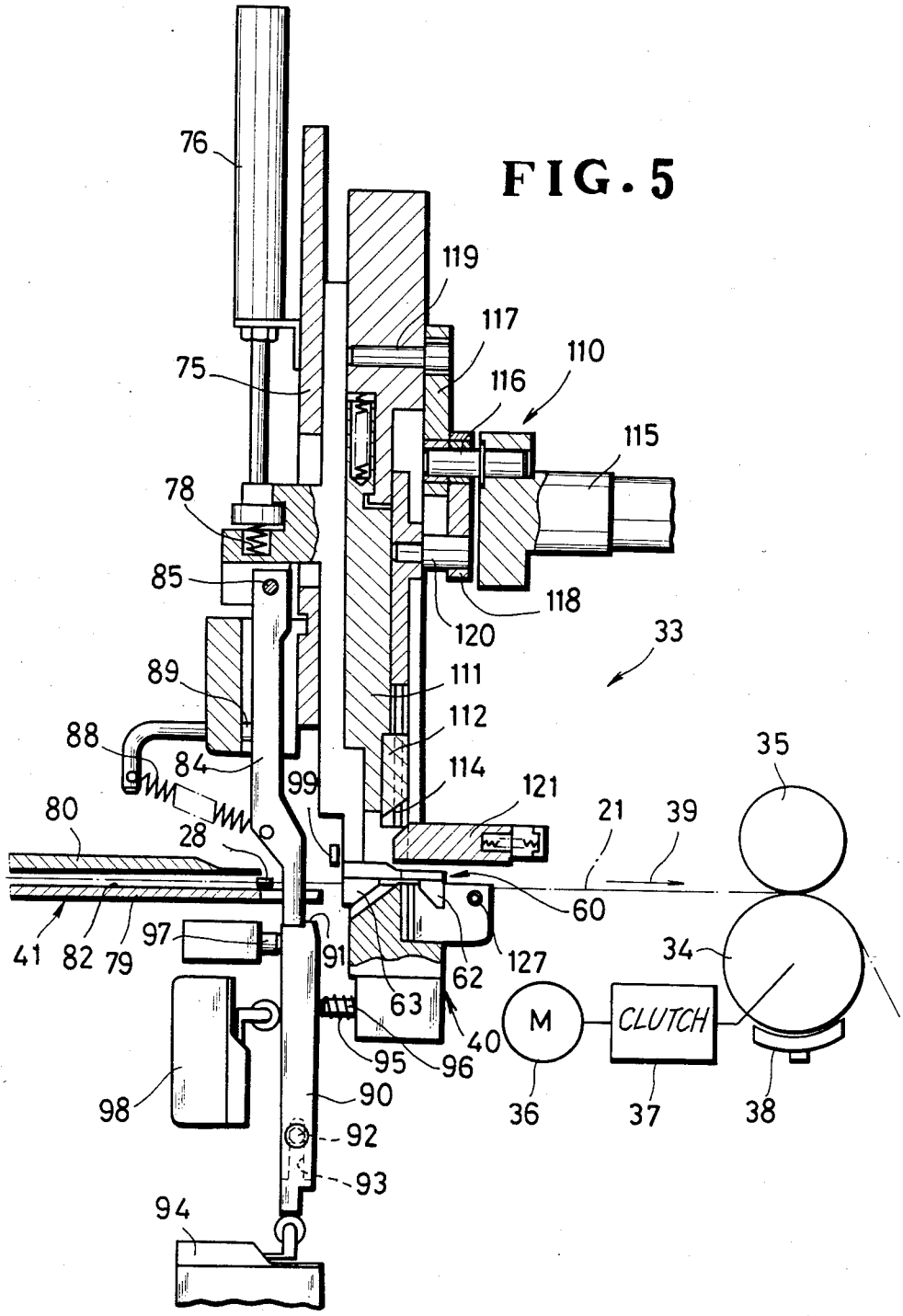
FIGS. 5 and 6 are vertical cross-sectional views of the apparatus of FIG. 2, showing different stages of operation for applying a top stop.
Figure 15:
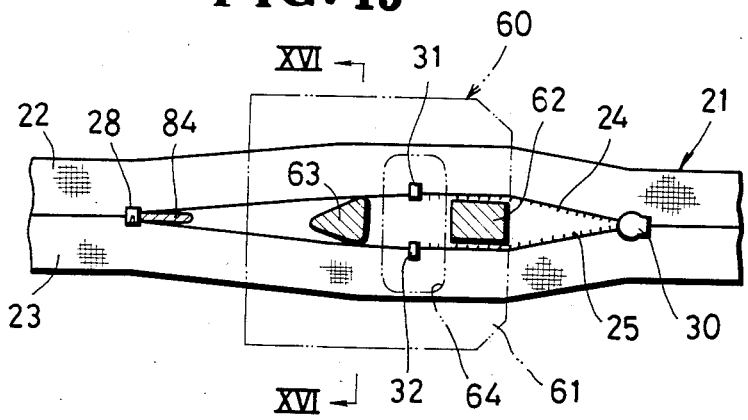
FIG. 15 is a plan view partly in cross section of a slide fastener chain on the apparatus as operated to the position of FIG. 6.
Figure 20:
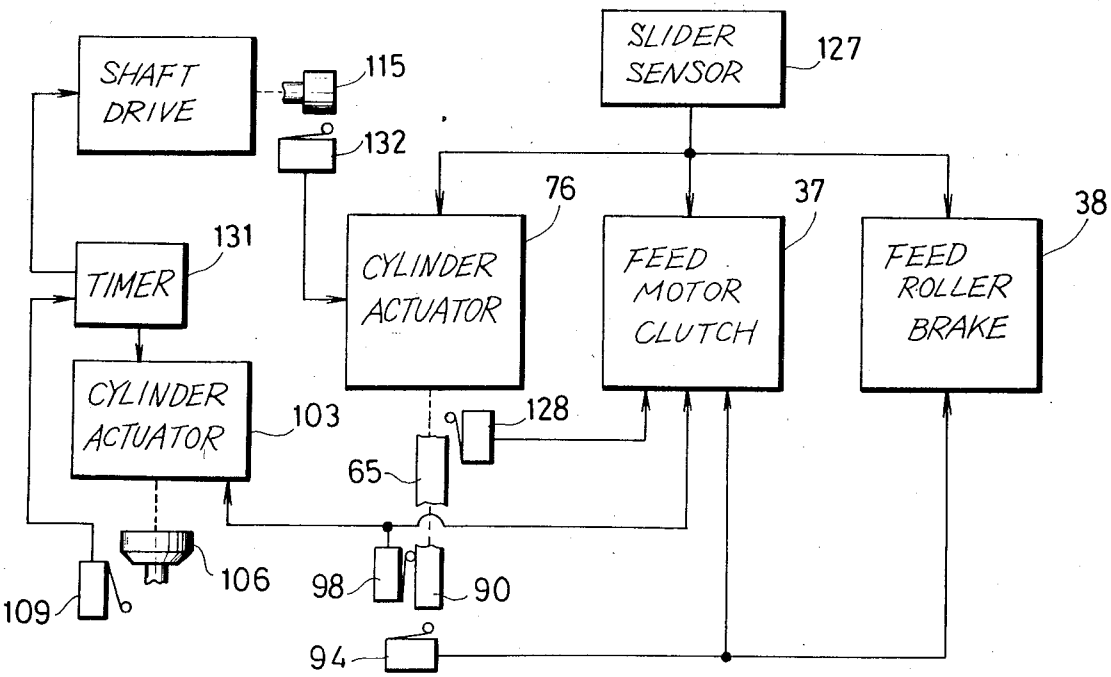
FIG. 20 is an electrical diagram of an electric control circuit for operating the apparatus of the invention.

Operation of the apparatus 33 thus constructed is as follows: FIG. 20 shows an electric control circuit for controlling the apparatus 33 for automatically applying top stops to the slide fastener chain 21. The slide fastener chain 21 is fed along in the direction of the arrow 39 (FIG. 2) by the presser roller 35 and the feed roller 34 which is driven by the motor 36 through the feed motor clutch 37. While the slide fastener chain 21 is being fed along, the slider 30 is guided in and along the slider guide groove 82 in the rear guide 41, and the stringer tapes 22, 23 are guided over the upper surface 81. The slider 30 slides over the rear guide 41 and then the front guide 40, and is detected by the slider sensor 127, which then produces a signal to disconnect the feed motor clutch 37 and actuate the feed roller brake 38 for thereby stopping the slide fastener chain 21. The signal from the slider sensor 127 is also employed to actuate the fluid cylinder 76 for lowering the chain opening pad 60 and the chain stop lever 84. The front and rear legs 62, 63 of the chain opening pad 60 are forced between the stringer tapes 22, 23 spreading them apart at the gap 29 and adjacent coupling elements 24, 25 as shown in FIGS. 12 and 15. The stringer tapes 22, 23 are sandwiched resiliently between the presser plate 61 of the chain opening pad 60 and the slide surfaces 50, 51 of the front guide 40 as illustrated in FIGS. 16. The chain stop lever 84 is inserted downwardly between the stringer tapes 22, 23 through the slot 83 to displace the detector lever 90 downwardly until it actuates the limit switch 94 as shown in FIGS. 5. The limit switch 94 now issues a signal to the feed motor clutch 37 to connect the same and also to the feed roller brake 38 to release the same. The feed roller 34 is again rotated to feed the slide fastener chain 21.

Figure 19:
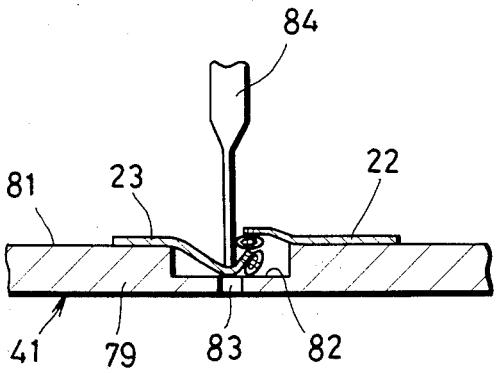

In case the inner edges of the stringer tapes 22, 23 get jammed between the slides 68, 69 of the rear leg 63 and the inner faces of the blocks 48, 49 of the front guide 40 as shown in FIG. 18, the chain opening pad 60 is prevented from being lowered further, and hence the limit switch 94 is not actuated. Similarly, when one of the stringer tapes 23 is placed over the slot 83 as shown in FIG. 19, the chain stop lever 84 fails to enter the slot 83, and the limit switch 94 is not turned on. Therefore, should one of these malfunctions occur, the slide fastener chain 21 would not be fed again. An alarm device may be provided for giving an alarm when the slide fastener chain is not fed again within a preset period of time after the slide fastener chain has been stopped in response to detection of the slider 30. This stoppage and alarm enables the operator to check any chain feed failures which would otherwise cause improper attachment of top stops 31, 32.

When the slide fastener chain 21 is fed along again in the direction of the arrow 39 (FIG. 5), a bottom stop 28 attached to the bottom end of a following pair of rows of coupling elements 24, 25 is brought into engagement with the chain stop lever 84. Since the slide fastener chain 21 is forcibly pulled by the feed roller 34, the chain stop lever 84 is slightly moved counterclockwise about the pin 85 against the resiliency of the spring 88. Then, the lower end of the chain stop lever 84 which engages the projection 91 of the detector lever 90 causes the latter to be turned clockwise about the pin 92 against the biasing force of the spring 95 until the detector lever 84 is held against the stopper 96. The limit switch 98 is now turned off to disengage the feed motor clutch 37, whereupon the slide fastener chain 21 comes to a stop in its free state without being braked by the roller brake 38. The ends of the rows of coupling elements 24, 25 where top stops are to be applied are positioned downstream of the clinching dies 46, 47 on the front guide 40.

Figure 6:
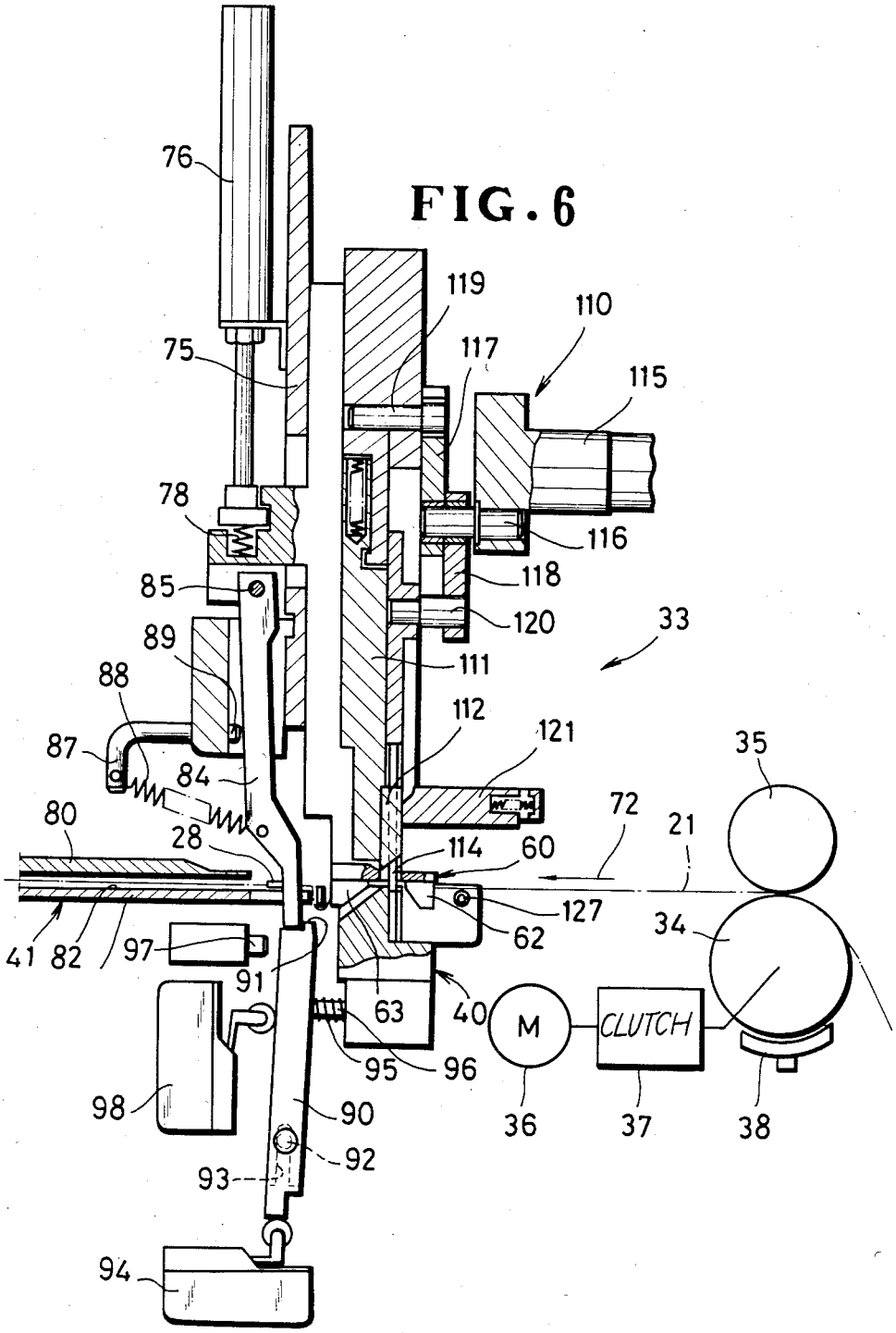

Simultaneously, the signal from the limit switch 98 is employed to actuate the fluid cylinder 103, which then extends its piston rod 104 and acts through the holder bar 100 to lower the chain deflector 99 as illustrated in FIGS. 7 and 8. The chain deflector 99 as it descends deflects the chain 21 downwardly as shown in FIGS. 6 and 14. Since the feed roller 34 is not braked, the feed roller 34 and the presser roller 35 being freely rotatable, and the bottom stop 28 being engaged by the chain stop lever 84 upstream thereof at this time, the slide fastener chain 21 that is positioned downstream of the deflector 99 is moved back in the direction of the arrow 72 (FIG. 6) by the lowering deflector 99 while rotating back the feed roller 34 and the presser roller 35. The ends of the rows of coupling elements 24, 25 where top stops are to be attached are now brought up against the element stopping marginal edges 55, 56 and positioned in the clinching dies 46, 47, respectively, as shown in FIG. 12. At this time, the confronting edges of the stringer tapes 22, 23 are kept parallel to each other by the front and rear legs 62, 63 of the chain opening pad 60. The core cords 26, 27 at the gap 29 extend through the recesses 53, 54 and ride on the steps 58, 59, respectively, on the front guide 40. When the ends of the coupling element rows abut against the stopper faces 55, 56, the rearward movement of the slide fastener chain 21 is arrested, and the chain deflector 99 is stopped. The downward stroke of the piston rod 104 of the fluid cylinder 103 is determined such that the piston rod 104 continues to descend after the chain deflector 99 has stopped its lowering movement. Such continued downward movement of the piston rod 104 does not lower the chain deflector 99 as the piston rod 104 is not fixed to the holder bar 100 but merely extends through the hole in the lateral plate 105. The chain deflector 99 is only resiliently urged downwardly under increasing forces from the compression spring 108 when it is compressed by the piston rod 104. Accordingly, the slide fastener chain 21 is prevented from being torn off by the chain deflector 99. The compression spring 108 as it is compressed serves to take up errors and variations in the lengths of the gaps 29 in the chain 21. The magnitude of such errors and variations in gap lengths that can be absorbed can be increased by increasing the stroke of the piston rod 104.

At the end of the stroke of the piston rod 104, the limit switch 109 is actuated by the disc 106 to actuate the fluid cylinder 103 in an opposite direction, that is, to retract the piston rod 104 upwardly for lifting the chain deflector 99 up to its starting position. At the same time, the limit switch 109 energizes a timer 131 (FIG. 20), which upon elapse of a present interval of time after the chain deflector 99 has started descending, actuates the clutch in the shaft drive mechanism to rotate the main shaft 115 through one revolution.

When the main shaft 115 begins rotating about its own axis, the cutter 112 and the curling punch 114 simultaneously start to be lowered at different speeds. The cutter 112 cuts top stop blanks from the flat wire bar 130 as fed by the wire feeder mechanism 129. The top stop blanks are bent by the benders 122 on the stop 121 into top stops 31, 32 (FIG. 14). The cutter 112 is continuously lowered to cause the lower slanted surface 123 to retract the stop 121 against the force of the spring 124. The curling punch 114 is now moved downwardly at a higher speed through the cutter 112 and the opening 64 in the chain opening pad 60, as shown in FIG. 17. The top stops 31, 32 are pushed downwardly by the curling punch legs 125, 126, respectively, until they pierce the stringer tapes 24, 25 across the ends of the coupling element rows disposed in the clinching dies 46, 47, respectively, and clinch the top stops 31, 32 around the coupling elements 24, 25. After the main shaft 115 has rotated through one revolution, that is, after the top stops 31, 32 are secured in place to the slide fastener chain 21, a limit switch 132 (FIG. 20) is actuated by the main shaft 115 to issue a signal for actuating the fluid cylinder 76 in the opposite direction to retract the chain opening pad 60 and the chain stop lever 84 upwardly to their starting position. The completion of upward movement of the pad holder 65 is sensed by the limit switch 128 which delivers a signal to the feed motor clutch 37 to rotate the feed roller 34 again for another cycle of top stop application.

Although various minor modification might be made or suggested by those versed in the art, it should be understood that I wish to embody within the scope of the patent warranted hereon, all such embodiments as reasonably and properly come within the scope of my invention.

I claim as my invention:

1. A method of automatically attaching top stops to a longitudinally gapped, continuous slide fastener chain composed of a pair of stringer tapes, pairs of rows of coupling elements mounted respectively on the stringer tapes and longitudinally spaced with gaps therebetween, bottom stops attached respectively to the pairs of rows of coupling elements at ends thereof, and sliders slidably mounted respectively on the pairs of rows of coupling elements, said method comprising the steps of:

(a) longitudinally feeding the slide fastener chain along a path in one direction;

(b) stopping the slide fastener chain in response to sensing the slider on one of the pairs of rows of coupling elements;

(c) spreading the stringer tapes horizontally from each other at one of the gaps adjacent to the slider and clamping the tapes in the horizontally spread position;

(d) after said clamping, restarting the feeding of the slide fastener chain in said direction until one of the bottom stops adjacent to said one of the gaps is engaged by a chain stop;

(e) laterally deflecting a non-clamped area of the element-free portion of the slide fastener chain transversely out of said path at a position downstream of the chain stop with respect to said one direction to longitudinally move a portion of the slide fastener chain downstream of said position in a direction opposite to said one direction until the opposite end of said one of the pair of rows of coupling elements is aligned with clinching dies;

(f) applying top stops to said opposite end by means of the clinching dies; and (g) feeding the slide fastener chain again along said path in said direction.

2. A method according to claim 1 including the step of repeating the steps (a) through (g).

3. An apparatus for automatically attaching top stops to a longitudinally gapped, continuous slide fastener chain composed of a pair of stringer tapes, pairs of rows coupling elements mounted respectively on the stringer tapes and longitudinally spaced with gaps therebetween, bottom stops attached respectively to the pairs of rows of coupling elements at ends thereof, and sliders slidably mounted respectively on the pairs of rows of coupling elements, said apparatus comprising:

(a) means for longitudinally feeding the slide fastener chain along a path in one direction;

(b) a pair of spaced front and rear chain guides disposed in said path for guiding the slide fastener chain to move along the path, said front guide having stationary clinching dies;

(c) a slider sensor on said front guide for sensing the slider on one of the pairs of rows of coupling elements for stopping said feed means;

(d) an apertured chain opening and clamping pad disposed above and movable downwardly to said front chain guide and having depending legs for spreading and then clamping the stringer tapes horizontally from each other at one of the gaps adjacent to said slider in response to the sensing of the latter by said slider sensor;

(e) a chain stop lever supported for vertical and pivotal movement and it also being responsive to said slider sensor for being moved downwardly into said one gap and disposed between said front and rear chain guides and arranged to restart said feed means, said lever being pivotable by the bottom stop adjacent to said one of the gaps and having a connection for restopping said feed means;

(f) a chain deflector disposed between said chain stop lever and said front chain guide and actuatable, in response to the restopping of the slide fastener chain, for laterally deflecting a non-clamped area of the element-free portion of the slide fastener chain to thereby reversely move said one of the pairs of rows of coupling elements longitudinally onto said stationary clinching dies; and (g) a top stop applicator for thereafter acting through the aperture of said chain pad for applying top stops to the end of said stringer tapes clamped by said pad against said stationary clinching dies.

4. An apparatus according to claim 3, said front chain guide including element stopping marginal edges located adjacent to and upstream of said clinching dies, respectively, for positioning an end of said one of pairs of rows of coupling elements in longitudinal alignment with said clinching dies.

5. An apparatus according to claim 3, said chain deflector extending transversely across said path, including a holder bar on which said chain deflector is mounted, a fluid cylinder having a piston rod, and a spring disposed around said piston rod and connected between said piston rod and said holder bar, said fluid cylinder being actuatable for moving said chain deflector transversely toward and across said path to deflect the slide fastener chain out of said path under resiliency from said spring.

6. An apparatus according to claim 3, said chain opening pad comprising a presser plate for pressing the stringer tapes against said chain guide and a pair of longitudinally spaced legs mounted on said presser plate and tapered away from the latter for insertion between the stringer tapes to spread them apart, said presser plate having its aperture positioned in substantial alignment with said clinching dies.

7. An apparatus according to claim 6, said top stop applicator including a curling punch movable through said pad opening toward and away from said clinching dies.

8. An apparatus according to claim 3, said slider sensor being disposed in said path downstream of said chain guide.

* * * * *